US005613848A

United States Patent [19]

Hashimoto et al.

[11] Patent Number: 5,613,848

[45] Date of Patent: Mar. 25, 1997

[54] PROCESS FOR THE PRODUCTION OF GLASS-LIKE CARBON SUBSTRATES FOR USE AS RECORDING MEDIA AND A SETTER FOR USE IN THE PROCESS

[75] Inventors: Ryoichi Hashimoto; Toshiya Shimada; Hiroshi Inatome, all of Wakayama; Manabu Shibata, Tochigi, all of Japan

[73] Assignee: Kao Corporation, Tokyo, Japan

[21] Appl. No.: 454,628

[22] Filed: May 31, 1995

[30] Foreign Application Priority Data

Jun. 1, 1994 [JP] Japan ..... 6-120325
Jul. 22, 1994 [JP] Japan ..... 6-170929

[51] Int. Cl.[6] ..... F27B 5/00

[52] U.S. Cl. ..... 432/253; 432/259; 248/309.1

[58] Field of Search ..... 211/59.1; 248/309.1; 269/47; 432/241, 253, 258, 259; 264/57, 58, 59

[56] References Cited

U.S. PATENT DOCUMENTS 3,948,594 4/1976 Irwin, Jr. ..... 432/253
4,132,763 1/1979 Schmidt et al. ..... 423/350
4,822,538 4/1989 Yoshida et al. ..... 264/29.5

FOREIGN PATENT DOCUMENTS 91-197309 3/1991 Japan ..... 31/2
3-197309 8/1991 Japan .

*Primary Examiner*—Henry A. Bennett
*Assistant Examiner*—Gregory Wilson
*Attorney, Agent, or Firm*—Oblon, Spivak, McClelland, Maier & Neustadt, P.C.

[57] ABSTRACT

A supporting shaft 11 that can be inserted through a center hole 5a in each of cured resin disks 5 and which has a bottom plate in a disk form at an end, as well as a plurality of spacer disks 12 each having a center hole through which the supporting shaft 11 can be inserted are used in the process of manufacturing GC (glass-like carbon) by baking to carbonize the cured resin disks 5. The cured resin disks 5 are stacked alternately with the spacer disks 12 on the supporting shaft 11 in an erect position that is inserted through the center holes in each of the cured resin and spacer disks. The stack is then baked in a baking furnace. By so doing, the cured resin disks can be set up easily and the baking furnace can be operated to its full capacity.

6 Claims, 6 Drawing Sheets

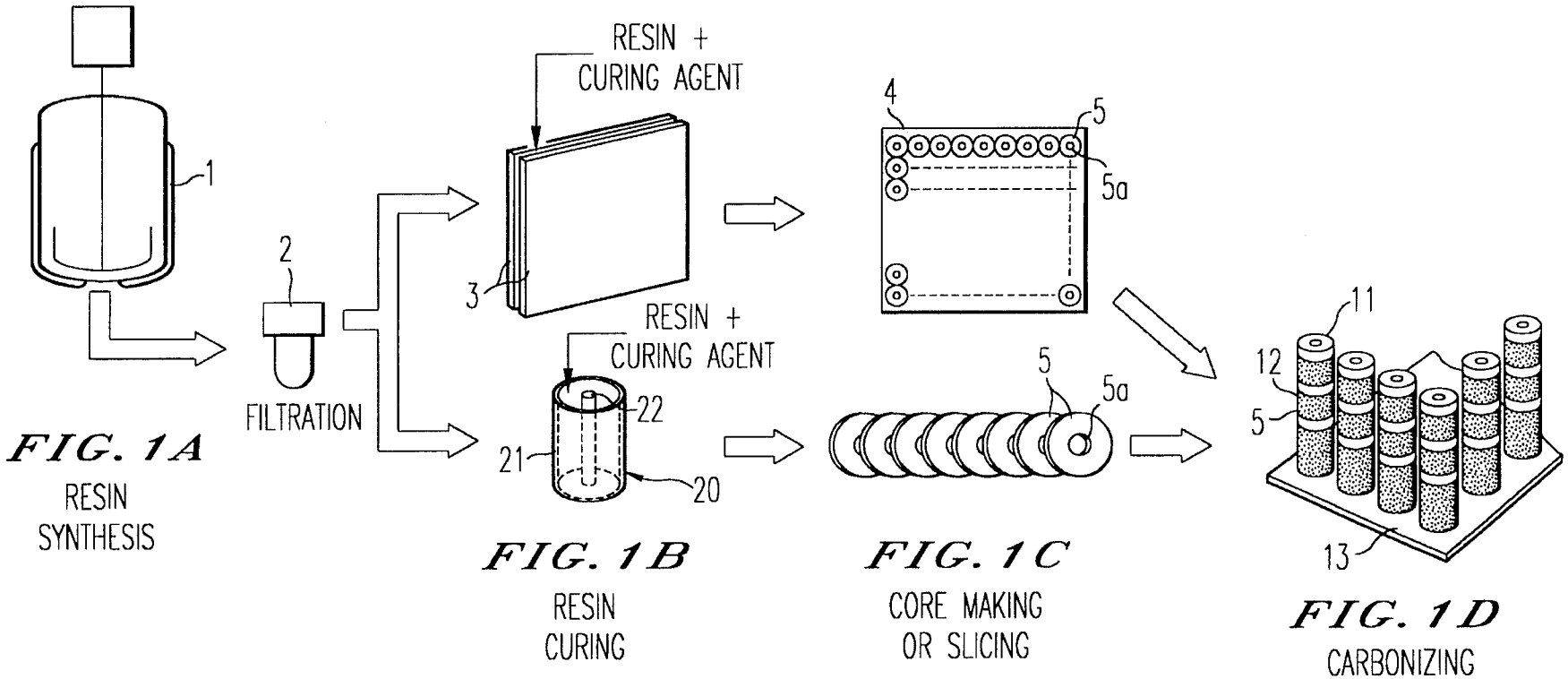
FIG. 1A RESIN SYNTHESIS
FIG. 1B RESIN CURING
FIG. 1C CORE MAKING OR SLICING
FIG. 1D CARBONIZING

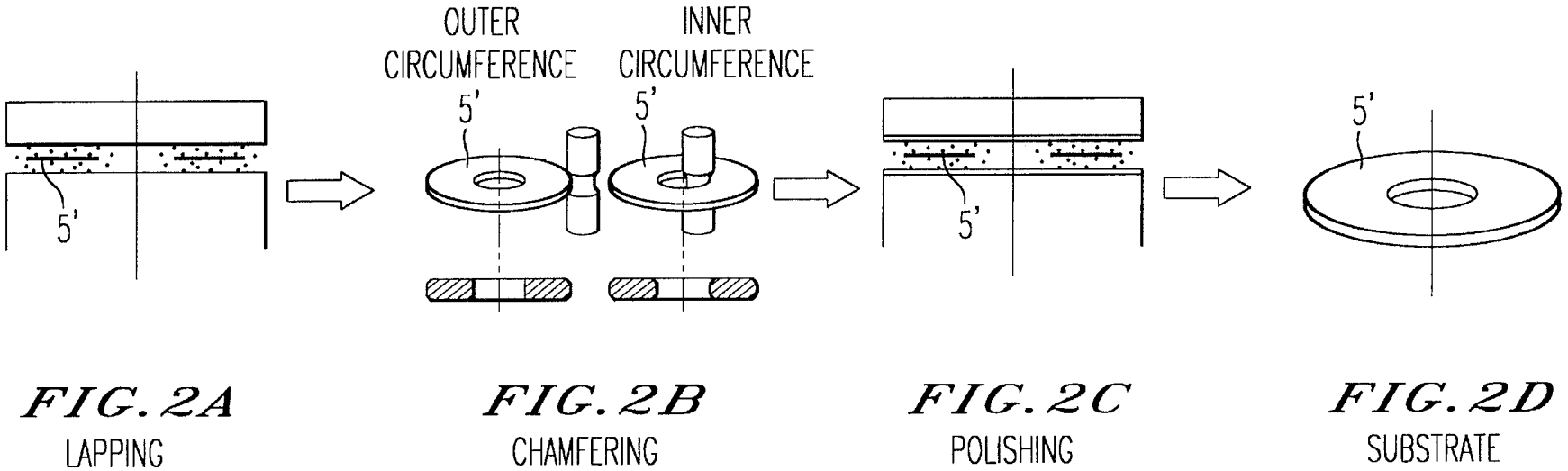
FIG. 2A LAPPING
FIG. 2B CHAMFERING
FIG. 2C POLISHING
FIG. 2D SUBSTRATE

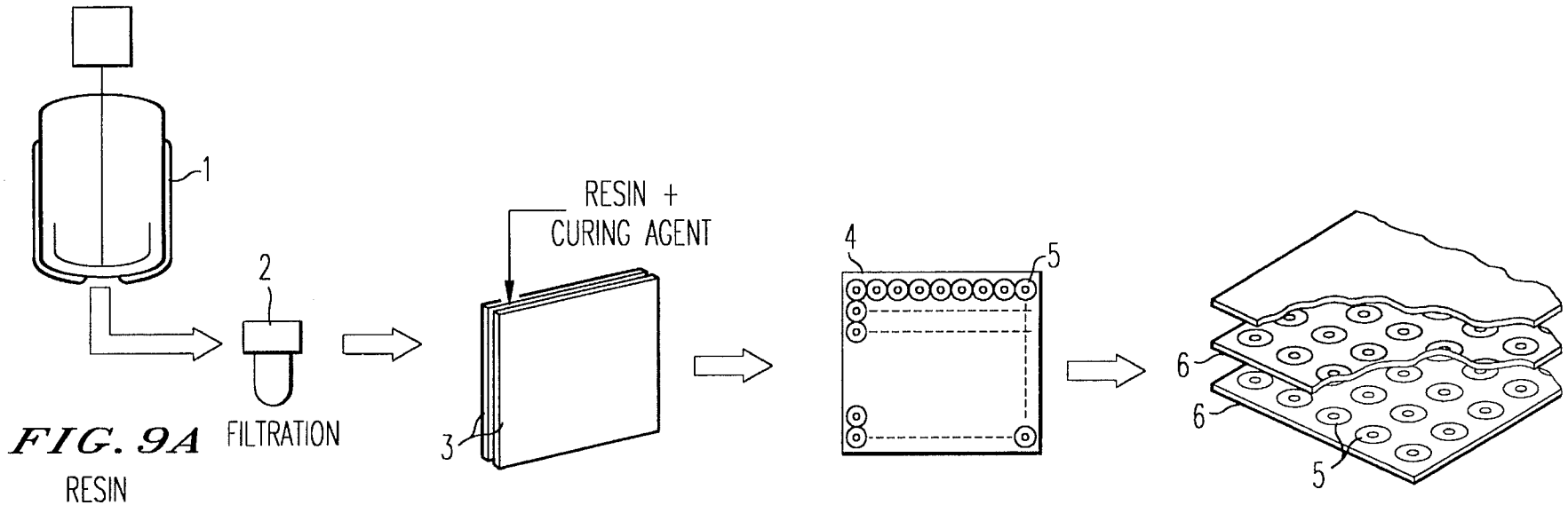
FIG. 9A RESIN SYNTHESIS
FIG. 9B RESIN CURING
FIG. 9C CORE MAKING
FIG. 9D CARBONIZING

PROCESS FOR THE PRODUCTION OF GLASS-LIKE CARBON SUBSTRATES FOR USE AS RECORDING MEDIA AND A SETTER FOR USE IN THE PROCESS

BACKGROUND OF THE INVENTION

The present invention relates to a process for the production of glass-like carbon (GC) substrates for use as recording media, as well as a setter for use in the process.

Aluminum has commonly been used as a material for the substrates of recording media typified by hard disks. In recent years, with a view to meeting various requirements such as higher impact resistance, lighter weight realized by reduction in thickness, and smaller power consumption by motors realized by reduction in weight, manufacturers are getting interested in "GC substrates" which are made of GC.

A conventional process for the manufacture of GC substrates is illustrated in FIGS. 9A to 9D. The process starts with a resin synthesis step, in which a phenol-modified furan resin is synthesized in a reaction vessel 1 and the synthesized liquid resin is filtered through a filter 2 (FIG. 9A). The process goes to a resin curing step, in which the liquid resin loaded with a curing agent is injected between a pair of glass plates 3 and left to stand at high temperature to effect a curing reaction (FIG. 9B). The cured resin is removed from a clearance between the glass plates 3 as a sheet 4 of a certain size.

The next step is core making, in which e number of disks 5 each having a center hole are cut out of the sheet 4 by a suitable means such as a laser cutter (FIG. 9C).

In the subsequent carbonizing step, a plurality of disks 5 (cured resin substrates) are placed side by side on a "setter" 6 (a flat plate typically made of graphite) in such a way that no adjacent disks will contact each other; another setter 6 is placed over the arranged disks 5 and another group of disks 5 are placed side by side on that setter in such a way that no adjacent disks will contact each other (FIG. 9D); a stack of setters 6 that support a specified number of disks 5 are placed in a baking furnace 7 (see FIG. 10) and baked at 1,000°–1,500° C. by a suitable means such as a graphite heater 8 in an inert gas (e.g. $N_2$ or Ar, etc.) atmosphere, whereby the cured resin is carbonized to yield GC substrates.

The cured resin substrates (disks) 5 placed between setters 6 should not contact one another; if adjacent disks 5 remain in contact with each other during baking, they will fuse together.

The GC substrates are given the flatness and surface roughness necessary for the final products through the sequence of a surface lapping step, an exterior/interior chamfering step, and a final polishing step.

The conventional process for the manufacture of GC substrates has had several problems. The performance of baking furnaces (e.g. an electric furnace and a gas furnace) is generally determined by the effective inner volume of the furnace and the total weight of the workpieces (cured resin substrates or disks) and the setters (flat plates). In the conventional process, a plurality of workpieces are baked as they are placed side by side between setters in such a way that adjacent workpieces do not contact each other. If the setters are made of graphite, their specific gravity ($\rho$=1.3–1.9) is greater than that of the workpieces which are made of a resin ($\rho$=1.1–1.4); additionally, the total volume of the setters is greater than that of the workplaces. Thus, it is no exaggeration to say that the setters rather than the workpieces are baked and, as a matter of fact, the baking furnace is not operated to its full capacity.

The conventional practice of arranging a plurality of disks between setters in such a way that adjacent disks will not contact each other has another problem; that is, if there are variations in thickness between disks, the thinner disks will move sidewise to contact adjacent disks to cause fusion as a result of baking.

In an alternative approach, the disks are placed alternately with spacers but this is not problem-free, either. The disks are not completely fixed in the position where they are stacked and, hence, the applied load is not distributed uniformly among all disks and warpage and other defects often occur in the baked disks.

SUMMARY OF THE INVENTION

The present invention has been accomplished under these circumstances and has as an object providing a process by which GC substrates for recording media can be produced with a baking furnace being operated to its full capacity and with disks (cured resin substrates) being easily set up and without the possibility of fusing to one another.

Another object of the invention is to provide a setter for use in implementing the above-described process.

Still another object of the invention is to provide a process by which GC substrates for recording media can be produced with a baking furnace being operated to its full capacity and with disks being easily set up and without the possibility of fusing to one another and which insures the disks to be baked in the substantial absence of warpage.

The baked object of the invention can be attained by a process for producing GC substrates for recording media by baking to carbonize a plurality of cured resin disks each having a center hole, which process comprises the steps of:

providing a supporting shaft that can be inserted through the center holes in the cured resin disks and a plurality of spacer disks each having a center hole through which said supporting shaft can be inserted;

stacking the cured resin disks alternately with the spacer disks on the supporting shaft in an erect position that is inserted through the center holes in each of said cured resin and spacer disks; and baking the stack of said cured resin and spacer resin disks in a baking furnace.

The baking object of the invention can be attained by a setter for use in the production of GC substrates for recording media by baking to carbonize a plurality of cured resin disks each having a center hole, which setter comprises:

a supporting shaft in an erect position that can be inserted through the center holes in the cured resin disks; and a plurality of spacer disks each having a center hole through which said supporting shaft can be inserted.

In a preferred embodiment, the outside diameter of each of the spacer disks is equal to or greater than the outside diameter of each of the cured resin disks and the inside diameter is equal to or smaller than the inside diameter of each of the substrates as produced by baking.

The object of the invention can be attained by a process for producing GC substrates for recording media by baking to carbonize a plurality of disks cured resin each having a center hole, which process comprises the steps of:

providing a supporting shaft that can be inserted through the center holes in the cured resin disks and a plurality of spacer disks each having a center hole through which said supporting shaft can be inserted, the outside diameter of each of said spacer disks being greater than that of each of said cured resin disks and the inside diameter being smaller than that of each of the substrates as produced by baking, each of said spacer disks having on at least one side thereof an annular elevation as thick as or thinner than each of the substrates as produced by baking, said annular elevation being located either outward of the outside diameter of each of said cured resin disks or inward of the inside diameter of each of the substrates as produced by baking or in both positions;

stacking the cured resin disks alternately with the spacer disks on the supporting shaft in an erect position that is inserted through the center holes in each of said cured resin and spacer disks; and baking the stack of said cured resin and spacer resin disks in a baking furnace.

The baking object of the invention can be attained by a setter for use in the production of GC substrates for recording media by baking to carbonize a plurality of cured resin disks each having a center hole, which setter comprises:

a supporting shaft in an erect position that can be inserted through the center holes in the cured resin disks; and a plurality of spacer disks each having a center hole through which said supporting shaft can be inserted, the outside diameter of each of said spacer disks being greater than that of each of said cured resin disks and the inside diameter being smaller than that of each of the substrates as produced by baking, each of said spacer disks having on at least one side thereof an annular elevation as thick as or thinner than each of the substrates as produced by baking, said annular elevation being located either outward of the outside diameter of each of said cured resin disks or inward of the inside diameter of each of the substrates as produced by baking or in both positions.

The annular elevation may be continuous or discontinuous in the circumferential direction.

The supporting shaft and the spacer disks are preferably made of materials that will not change in shape at 1,500° C. which is the highest temperature than can be reached in the baking furnace. More preferably, they are made materials that will not change in quality at 1,500° C. Any materials that satisfy these requirements may be used but carbon and ceramics are particularly preferred since they are recyclable and because high precision of flatness and parallelism can be provided for spacer disks. As the carbon, graphite and GC are actually used.

BRIEF DESCRIPTION OF THE DRAWINGS

FIGS. 1A–1D show the first part of the process of manufacturing GC substrates starting with a resin synthesis step and ending with a carbonizing step;

FIGS. 2A–2D show the second part of the process of manufacturing GC substrates starting with a lapping step and ending with the completion of the final product;

FIGS. 9A–9D show the essential part of the prior art process for the manufacture of GC substrates.

DETAILED DESCRIPTION OF THE INVENTION

Figure 3A:
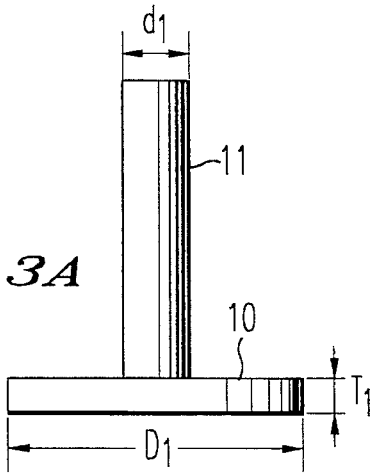
FIGS. 3A and 3B show the supporting shaft for use in the carbonizing step.

According to the present invention, the cured resin disks are stacked alternately with the spacer disks on the supporting shaft in an erect position that is inserted through the center holes in each of said cured resin and spacer disks, and the stack of said cured resin and spacer disks are baked in a baking furnace. By so doing, the total volume and weight of the setter (consisting of the supporting shaft and the spacer disks) can be significantly reduced compared to the existing setter in the form of flat plates. As a result, the baking furnace can be operated to its full capacity so that an increased number of substrates can be produced in a single baking step.

Since one only need insert the supporting shaft through the cured resin disks in order to restrict their movement, not only can the cured resin disks be set up easily but they can also be prevented from contacting and hence fusing to each other whether or not there are variations in their thickness.

In a preferred embodiment, the outside diameter of each of the spacer disks is made equal to or greater than that of each of the cured resin disks yet to be baked and the inside diameter is made equal to or smaller than that of each of the substrates as produced by baking. This design is effective in ensuring positively against the fusion of cured resin disks by preventing adjacent disks from contacting each other not only before but during the baking step.

In a further preferred embodiment, an annular elevation is provided on at least one side of each spacer disk in a location slightly outward of the outside diameter of each of the cured resin disks. By so doing, the cured resin disk is securely fixed on the spacer disk at its outside diameter and none of the cured resin disks will be displaced in the setup step. If the annular elevation is provided in a location slightly inward of the inside diameter of each of the substrates as produced by baking, there is only a small likelihood for the displacement of substrates even at a time close to the end of the baking step. Hence, the annular elevation need be provided either outward of the outside diameter of the cured resin disk or inward of the inside diameter of the substrate as produced by baking or in both locations. Thus, the spacer disks are so shaped that a uniform load is applied to the cured resin disks at all times throughout the baking step and the substrates as produced by baking are substantially free from warpage. Such substrates that are substantially free from warpage need be worked by only a reduced amount in the subsequent lapping step and, hence, the time required for this lapping step can be shortened.

The materials of construction of the supporting shaft and the spacer disks are not limited to any particular types but they are preferably made of materials that will not change in shape or quality even that 1,500° C. which is the highest temperature that can be reached in the baking furnace. If materials that will not change in shape at 1,500° C. are used, substrates of consistent shape can be produced by baking. If materials that will not change in quality at 1,500° C. are used, recyclable supporting shafts and spacer disks can be constructed.

Materials of construction that satisfy the requirement for the absence of changes in shape and quality at 1,500° C. include carbon and ceramics. The use of such materials enables the recycling of the supporting shaft and spacer disks. Graphite is particularly desirable since it has no voids that can potentially trap a variety of gases and, hence, it will not cause any undesirable chemical changes in the completed substrates. Among carbon species, GC is especially preferred since in addition to the inherent characteristics of carbon, it not only insures a fairly high precision in the flatness and parallelism of spacer disks but also allows for an improvement in the efficiency of the baking operation on account of its small specific gravity.

The cured resin is selected from phenol resins, phenol-modified furan resins, epoxy resins, unsaturated polyester resins, furan resins, urea resins, melamine resins, alkyd resins, xylene resins, carbodiimide resins, urethane resins, and a mixture thereof. In these resins, the phenol-modified furan resin is preferable in terms of obtaining a non-porous substrate.

The preferred examples of the invention will now be described with particular reference to the case where GC substrates having an outside diameter (o.d.) of 65 mm, an inside diameter (i.d.) of 20 mm and a thickness of 0.635 mm are formed as the final product. FIGS. 1A–1D and FIGS. 2A–2D show the whole aspects of the process of manufacturing GC substrates according to the invention, which comprises the following steps: (1) resin synthesis, (2) resin curing, (3) core making or slicing, (4) carbonizing, (5) lapping, (6) chamfering, and (7) polishing.

EXAMPLE 1

In the resin synthesis step, a phenol modified furan resin is synthesized in reaction vessel 1. The phenol modified furan resin employed in Example 1 is synthesized in the following manner:

(i) A mixture (a) which contains 500 parts of furfuryl alcohol, 470 parts of 92% paraformaldehyde, and 190 parts of water is raised to a temperature of 80° C. while stirring the mixture (a);

(ii) While stirring a mixture (b) which contains 670 parts of phenol and 18 parts of calcium hydroxide at a temperature of 80° C., drops of the mixture (b) are added to the mixture (a) to thereby obtain a mixture (c);

(iii) After the drops-adding finishes, the mixture (c) is aged for 3 hours at a temperature of 80° C.;

(iv) After the mixture (c) is cooled to a room temperature, the mixture (c) is adjusted to weak acid (pH=3 to 5) with 62% paratoluenesulfonic acid; and (v) After the mixture (c) is diluted with 500 parts of furfuryl alcohol, the mixture (c) is dehydrated at a temperature of 60° C. under a reduced pressure to thereby remove 200 parts of water. Thus, the phenol modified furan resin having a viscosity of 300 cps (at 25° C.) is obtained.

Further, after the phenol modified furan resin is synthesized to a liquid by the above-described manner, the liquid resin is filtered through filter 2.

In the resin curing step, a pair of glass plates 3 typically spaced apart by a distance of 1.2 mm are fitted on he periphery with an O-ring as a sealant; thereafter, a liquid resin mixed with a curing agent is injected between the glass plates 3 and allowed to cure by reaction under specified conditions; the cured resin is removed from between the glass substrates 3 as a sheet in a thickness of about 1.2 mm. Alternatively, a mold 20 comprising a cylinder 21 with a bottom and a rod 22 that is erected from the center of the bottom is provided; thereafter, a resin mixed with a curing agent is injected into the mold 20 and allowed to cure by reaction under specified conditions; the cured resin is taken out of the mold 20 as a cylindrical part having the following approximate dimensions, 88 mm in o.d., 25 mm in i.d., and 300 mm in length.

The process goes to either the core making or slicing step depending on the shape of the cured resin; if it is in a sheet form, it is transferred to the core making step and if it is a cylindrical part, it is transferred to the slicing step.

In the core making step, a number of cured resin disks measuring 88 mm in o.d. and 25 mm in i.d. are cut out of the cured resin sheet (ca. 1.2 mm in thickness) by a suitable means such as a laser cutter. In the slicing step, the cured resin cylinder measuring 88 mm in o.d. and 25 mm in i.d. is sliced with a suitable means such as a cutting tool or a diamond cutter to give a number of cured resin disks 5 in a thickness of about 1.2 mm.

Figure 4A:
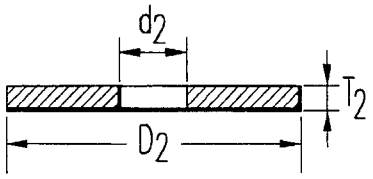
FIGS. 4A and 4B show the spacer disk for use in the carbonizing step in the first example of the invention.
Figure 3B:
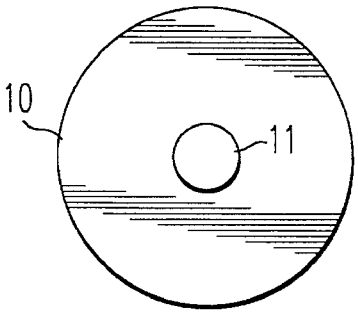
Figure 4B:
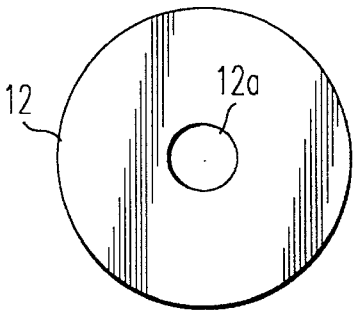

In the carbonizing step, a setter comprises a supporting shaft 11 typically made of graphite that can be inserted through a center hole **5*a* in the cured resin disk 5 yet to be baked and which has a flange-like bottom plate 10 in a disk form secured at one end (see FIGS. 3A and 3B) and a spacer disk 12 typically made of graphite that has a center hole 12a through which the supporting shaft 11 can be inserted (see FIGS. 4A and 4B). A number of spacer disks 12 should be provided for one supporting shaft 11**.

Figure 5:
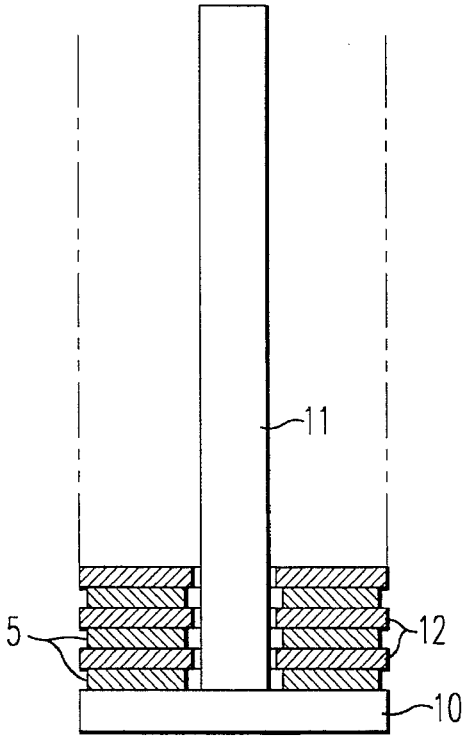
FIG. 5 shows how cured resin disks are stacked alternately with spacer disks on the supporting shaft in the first example of the invention.
Figure 10:
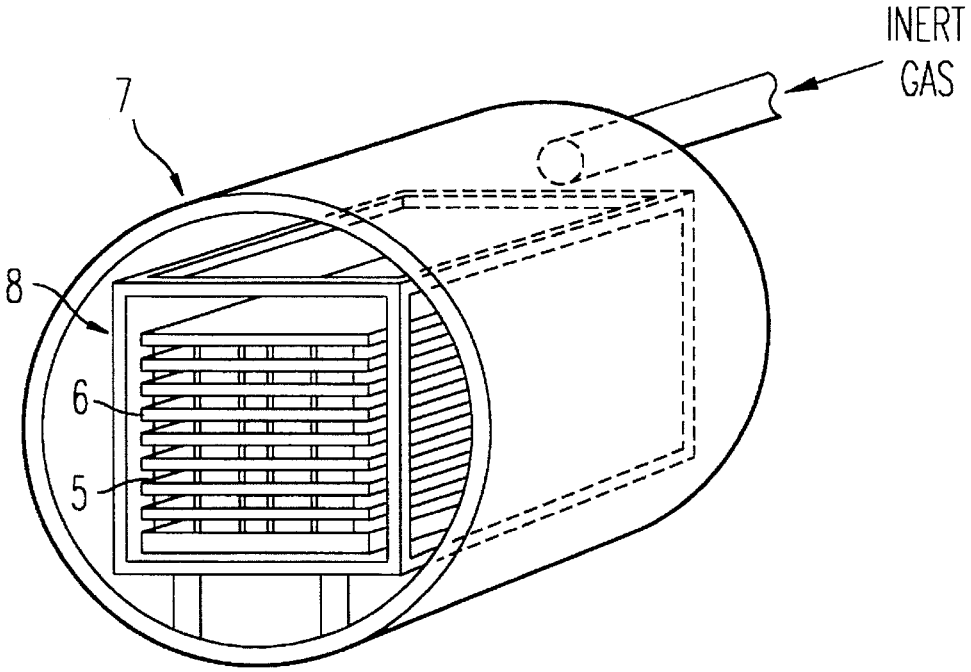
FIG. 10 illustrates how the stack of cured resin disks is baked in the prior art.

As shown in FIG. 5, the supporting shaft 11 is held in an erect position with the bottom plate 10 facing down and the cured resin disks 5 are stacked alternately with the spacer disks 12 on the shaft 11 as it is inserted through the center holes in the disks. Thereafter, a weight is placed on top of the stack. A number of such stacks are placed on a single flat graphite plate 13 as shown in FIGS. 1A–1D, loaded into a baking furnace 7 (see FIG. 10) and baked in an inert gas (e.g. Ar or $N_2$, etc.) atmosphere, typically by means of a graphite heater 8, at a temperature of 1,000°–1,500° C., whereby the cured resin disks 5 are carbonized to produce GC substrates. The cured resin disks 5 will shrink to about 70–80% of the initial volume as a result of baking. In Example 1, the shrinkage is about 75% of the initial volume.

If the combination of the supporting shaft 11 and spacer disks 12 is used as the setter, the total volume and weight of the setter can be reduced significantly compared to those of the conventional setter in the form of flat plates. As a result, the baking furnace can be operated to its full capacity so that an increased number of substrates can be produced in a single baking step.

Since one only need insert the supporting shaft 11 through the cured resin disks 5, the disks can be set up easily; additionally, the shaft 11 can restrict the movement of the disks 5 and, hence, they can be prevented from contacting and hence fusing to each other whether or not there are variations in their thickness.

The supporting shaft 11 and the spacer disks 12 have preferably the following dimensions. The diameter, d1, of the supporting shaft 11 is smaller than the inside diameter of the GC substrate as produced by baking; preferably, d1 is 18 mm. The outside diameter, D1, of the bottom plate 10 of the supporting shaft 11 is equal to or greater than the outside diameter of the cured resin disk yet to be baked; preferably, D1 is 90 mm.

The inside diameter, d2, of the spacer disk 12 (i.e., the diameter of the center hole 12*a*) is smaller than the diameter of the center hole in the GC substrate as produced by baking but greater than the diameter, d1, of the supporting shaft 11; preferably, d2 is 19 mm. The outside diameter, D2, of the spacer disk 12 is greater than the outside diameter of the cured resin disk 5 yet to be baked, preferably equal to the outside diameter, D1, of the bottom plate 10 of the supporting shaft 11; hence, D2 is preferably 90 mm.

The thickness, T1, of the bottom plate 10 of the supporting shaft 11 is typically set at 10 mm in consideration of the supporting strength if it is made of graphite. On the other hand, the thickness, T2, of the spacer disk 12 need be of a such a value that it will not deflect under its own weight and if it is made of graphite, about 1 mm will suffice. It should, however, be noted that T2 is preferably uniform, or entirely free from unevenness. Since the surface profile of the spacer disk 12 is transferred onto the surface of the baked disk, any unevenness in the thickness of the spacer disk 12 will cause a corresponding unevenness in the thickness of the baked disk.

In Example 1, the supporting shaft 11 and the spacer disks 12 should be made of graphite because it has no potential to evolve reactive gases during the baking step.

In Example 1, the supporting shaft 11 is fitted with the flange-like bottom plate 10 in a disk form at an end so that it is capable of standing by itself. This structure provides ease in holding the shaft 11 in an erect position; it should, however, be noted that the bottom plate 10 is not limited to the disk form and that, if desired, a number of supporting shafts may be mounted in an erect position on a single, large bottom plate.

Subsequent to the carbonizing step, the GC substrates 5' are subjected to a lapping, a chamfering and a polishing step as shown in FIGS. 2A–2D in order to provide the flatness and surface roughness necessary for the final product.

The steps described above complete the fabrication of the GC substrates 5' as the final product.

Figure 6A:
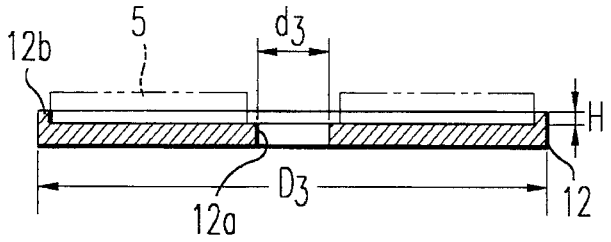
FIGS. 6A and 6B show the spacer disk with an annular elevation for use in the carbonizing step in the second to the fourth example of the invention.
Figure 6B:
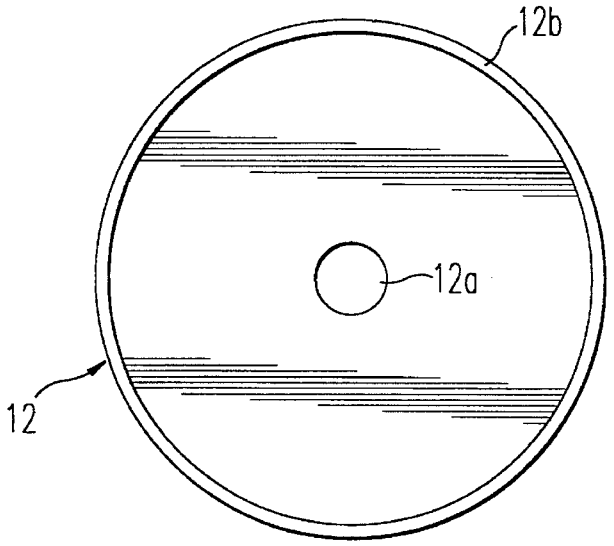

We now describe the second to the fourth example. In these examples, spacer disk 12 as a component of the setter for use in the carbonizing step is constructed as shown in FIGS. 6A and 6B: it has a center hole 12*a* through which the supporting shift 11 can be inserted; its outside diameter D3 is greater than the outside diameter of the cured resin disk 5 and its inside diameter d3 is smaller than the inside diameter of the substrate 5' as produced by baking; the spacer disk has on one side thereof an annular elevation 12*b* that is as thick as or thinner than the substrate 5' and which is located outward of the outside diameter of the cured resin disk 5.

Figure 7A:
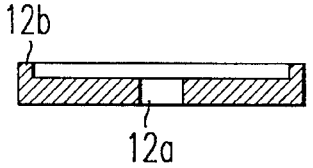
FIGS. 7A–7F show various designs of the spacer disk with an annular elevation.
Figure 7B:
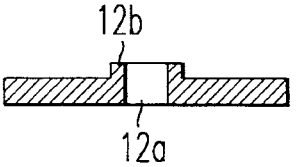
Figure 7C:
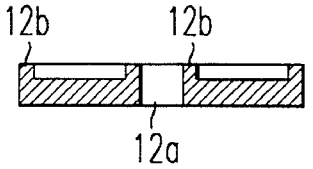
Figure 7D:
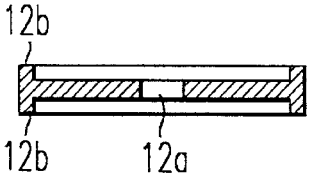
Figure 7E:
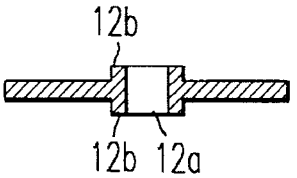
Figure 7F:
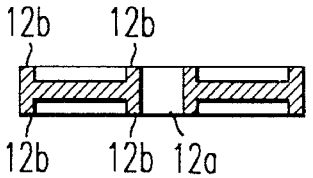

FIGS. 7A–7F 8how various designs of spacer disk that permit the applied load to be distributed uniformly among the cured resin disks. In the second to the fourth example, the spacer disk shown in FIG. 7A is used.

Figure 8A:
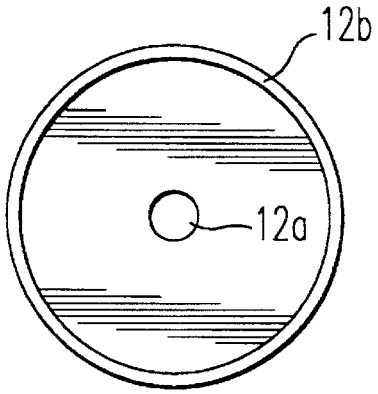
FIGS. 8A and 8B show two basic designs of the annular elevation.
Figure 8B:
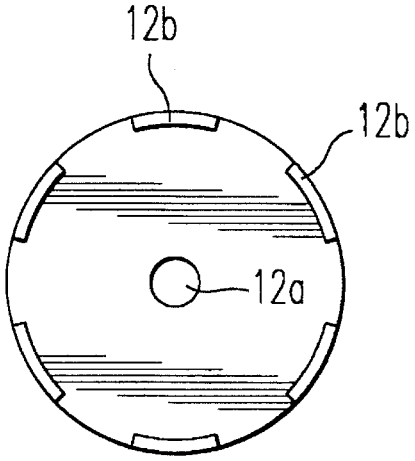

The annular elevation 12*b* may be continuous as shown in FIG. 8A or discontinuous as shown in FIG. 8B. In the second to the fourth example, the continuous design shown in FIG. 8A is used.

EXAMPLE 2

Example 2 is the same as Example 1 (see FIG. 3A, 3B, 4A and 4B), except that spacer disks with an annular elevation are used and that the dimensions of the supporting shaft 11 and the spacer disks are changed as follows.

The diameter, d1, of the shift 11 is the same as in Example 1 (18 mm) but the outside diameter, D1, of the bottom plate 10 is changed to 92 mm. The inside diameter, d3, of the spacer disk 12 (i.e., the inside diameter of the center hole 12*a*) is the same as in Example 1 (19 mm). The outside diameter, D3, of the spacer disk 12 is the same as that of the bottom plate 10 (92 mm).

The annular elevation 12*b* provided on the circumference of one side of the spacer disk 12 has a width of 1.5 mm and is located outward of the position at 89 mm which exceeds the outside diameter of the cured resin disk (88 mm ). The annular elevation 12*b* has a height (H) of 0.3 mm.

Both the supporting shaft 11 and the spacer disks 12 are made of graphite (IG-43 of Toyo Carbon Co., Ltd.) which will not deform the cured resin disks even at the highest temperature (e.g. 1,500° C.) that can be reached in the baking furnace.

If the cured resin disks are stacked alternately with the spacer disks characterized above, a uniform load will apply to all of the cured resin disks. When they were baked, GC substrates were obtained that did not have any more warpage than the cured resin disks before baking.

The GC substrates were then subjected to a lapping, a chamfering and a polishing step as shown in FIGS. 2A–2D in order to provide the flatness and surface roughness necessary for the final product.

The GC substrates produced by using the setter of Example 2 were substantially free from warpage and, hence, the lapping step could be completed within a shorter time than in Example 1.

EXAMPLE 3

GC substrates were produced by repeating the procedure of Example 2 except that the supporting shaft and the spacer disks were made of silicon carbide (SC-221 of KYOCERA CORP.). The GC substrates thus produced were substantially free from warpage.

EXAMPLE 4

GC substrates were produced by repeating the procedure of Example 2 except that the spacer disks were made of GC. The GC substrates thus produced were substantially free from warpage and, hence, the lapping step could be completed within a shorter time than in Example 1.

Comparative Example.

Cured resin disks formed as in Examples 1–4 were placed side by side on a flat graphite plate commonly called a setter (measuring 400 mm×700 mm×20 mm) in such a way that no adjacent disks would contact each other; another flat graphite plate was placed over the disks and another group of cured resin disks were arranged in the same manner. The stack of cured resin disks placed on the flat plates were baked under the same conditions as in Examples 1–4 to produce GC substrates. Since not only the cured resin disks but also the flat plates varied in thickness, the GC substrates produced had local warpage. Those GC substrates which had particularly serious warpage were poor in surface flatness and had to be straightened out by removing a significant portion in the lapping step. Additionally, the effective volume of the baking furnace and the total loading weight were mostly occupied by the setters and, hence, the performance of the baking furnace was very low.

As described on the foregoing pages, the process of the present invention for producing GC substrates and the setter for use in that process are characterized in that cured resin disks are stacked alternately with spacer disks on a supporting shaft in an erect position that is inserted through the center holes in each of the cured resin and spacer disks and that the stack of said cured resin and spacer disks are baked in a baking furnace. By so doing, the total volume and weight of the setter (consisting of the supporting shaft and the spacer disks) can be significantly reduced compared to the prior art setter in the form of flat plates. As a result, the baking furnace can be operated to its full capacity so that an increased number of substrates can be produced in a single baking step.

Since one only need insert the supporting shaft through the cured resin disks in order to restrict their movement, not only can the cured resin disks be easily set up but they can also be prevented from contacting and hence fusing to each other whether or not there are variations in their thickness.

If the outside diameter of each of the spacer disks is made equal to or greater than that of each of the cured resin disks yet to be baked and if the inside diameter is made equal to or smaller than that of each of the substrates as produced by baking, one can positively ensure against the fusion of cured resin disks by preventing adjacent disks from contacting each other not only before but during the baking step.

If an annular elevation is additionally provided on the circumference of each spacer disk, the cured resin disks stacked alternately with the spacer disks are securely fixed and prevented from relative displacements, thus ensuring that a uniform load will be applied to all of the cured resin disks in stack. As a result, one can fire the cured resin disks to produce GC substrates that are substantially free from warpage which has heretofore developed on account of an unevenly applied load.

If the spacer disks are made of carbon or ceramics, a fairly high degree of precision can be attained in both the flatness and parallelism of the spacer disks. This is not only effective in preventing the warpage, if any, of spacer disks from being transferred onto the surface of cured resin disks during baking; the GC substrates produced by baking are also essentially free from warpage and the time required for the subsequent lapping step can be significantly reduced.

What is claimed is:

1. A setter for use in the production of glass-like carbon substrates for recording media by baking to carbonize a plurality of cured resin disks each having a center hole, the setter comprising:

a supporting shaft in an erect position that is inserted through the center holes in the cured resin disks; and a plurality of spacer disks each having a center hole through which said supporting shaft can be inserted wherein said cured resin disks are alternately stacked with said spacer disks.

2. A setter according to claim 1, wherein the outside diameter of each of said spacer disks is equal to or greater than the outside diameter of each of said cured resin disks and wherein the inside diameter of each of said spacer disks is equal to or smaller than the inside diameter of each of the substrates as produced by baking.

3. A setter for use in the production of GC substrates for recording media by baking to carbonize a plurality of cured resin disks each having a center hole, the setter comprising:

a supporting shaft in an erect position that inserted through the center holes in the cured resin disks; and a plurality of spacer disks each having a center hole through which said supporting shaft can be inserted, the outside diameter of each of said spacer disks being greater than that of each of said cured resin disks and the inside diameter being smaller than that of each of the substrates as produced by baking, each of said spacer disks having on at least one side thereof an annular elevation as thick as or thinner than each of the substrates as produced by baking, said annular elevation being located either outward of the outside diameter of each of said cured resin disks or inward of the inside diameter of each of the substrates as produced by baking or in both positions.

4. A setter according to any one of claims 1, 2 and 3, wherein either said spacer disks or both said supporting shaft and said spacer disks are made of graphite.

5. A setter according to any one of claims 1, 2 and 3, wherein either said spacer disks or both said supporting shaft and said spacer disks are made of ceramics.

6. A setter according to any one of claims 1, 2 and 3, wherein either said spacer disks or both said supporting shaft and said spacer disks are made of glass-like carbon.

* * * * *